United States Patent [19]

Jordan

[11] 4,260,155

[45] Apr. 7, 1981

[54] MARBLE RUNWAY GAME APPARATUS

[76] Inventor: Anthony Jordan, 4514 Weyburn Dr., Annandale, Va. 22003

[21] Appl. No.: 26,163

[22] Filed: Apr. 2, 1979

[51] Int. Cl.[3] ..... A63F 7/02

[52] U.S. Cl. ..... 273/120 R; 273/138 R

[58] Field of Search ..... 273/120 R, 127 D, 138 R

[56] References Cited

U.S. PATENT DOCUMENTS

| | | | |
|---|---|---|---|
| 156,774 | 11/1874 | Daniels | 273/120 R |
| 983,592 | 2/1911 | Wood | 273/120 R |
| 1,656,272 | 1/1928 | Ekstein | 273/120 R |

FOREIGN PATENT DOCUMENTS

| | | | |
|---|---|---|---|
| 212818 | of 1910 | Fed. Rep. of Germany | 273/120 R |
| 487931 | 12/1929 | Fed. Rep. of Germany | 273/120 R |
| 89553 | 6/1922 | Sweden | 273/120 R |

*Primary Examiner*—Peter Chin

*Attorney, Agent, or Firm*—Raymond N. Matson

[57] ABSTRACT

A marble runway type of game apparatus for children which provides amusement and requires skill and which is of the knock-down type and formed of readily interfitting parts of any suitable material and may be easily molded of any suitable plastic.

7 Claims, 4 Drawing Figures

MARBLE RUNWAY GAME APPARATUS

This invention relates generally to game apparatus for children and more particularly to a marble runway game apparatus.

Games of this type are well known in the art and as a whole, are characterized by a number of inherently objectionable features. Among these are: a large, heavy and cumbersome structure making it difficult to move to and from the play area and to store; a lack of imagination of design so as to be unattractive to children; a poor design and arrangement of the runways so that play is controlled merely by chance rather than skill so as to quickly become boring; and a poor and costly design from a manufacturing standpoint so that it is impossible to mold the apparatus by inexpensive and simple molds.

Accordingly, the main object of the present invention is to provide an improved marble runway game apparatus for children which will obviate the above and other objectionable features characterizing known structures.

An important object of the present invention is to provide an improved game apparatus of the marble runway type in which a player may control the length of the run of each marble and hence the speed thereof so as to affect, to a degree, the discharge of the marble against a given one of several targets.

Another important object of the present invention is to provide an improved marble runway apparatus of the knock-down type in which the parts are interfitting and intercooperative so as to be readily assembled by a child player.

A further important object of the present invention is to provide a knock-down type marble runway game apparatus in which each of the interfitting and intercooperating parts may be readily molded of a suitable plastic material so as to be lightweight and readily carried by a child.

A still further important object of the present invention is to provide an improved knock-down type of marble runway game apparatus which is susceptible of ready and economic manufacture, and which is strong and will be of long life in use.

Other objects and advantages of the present invention will become apparent during the course of the following description.

In the drawings, I have shown two embodiments of the invention. In these showings:

Figure 1:
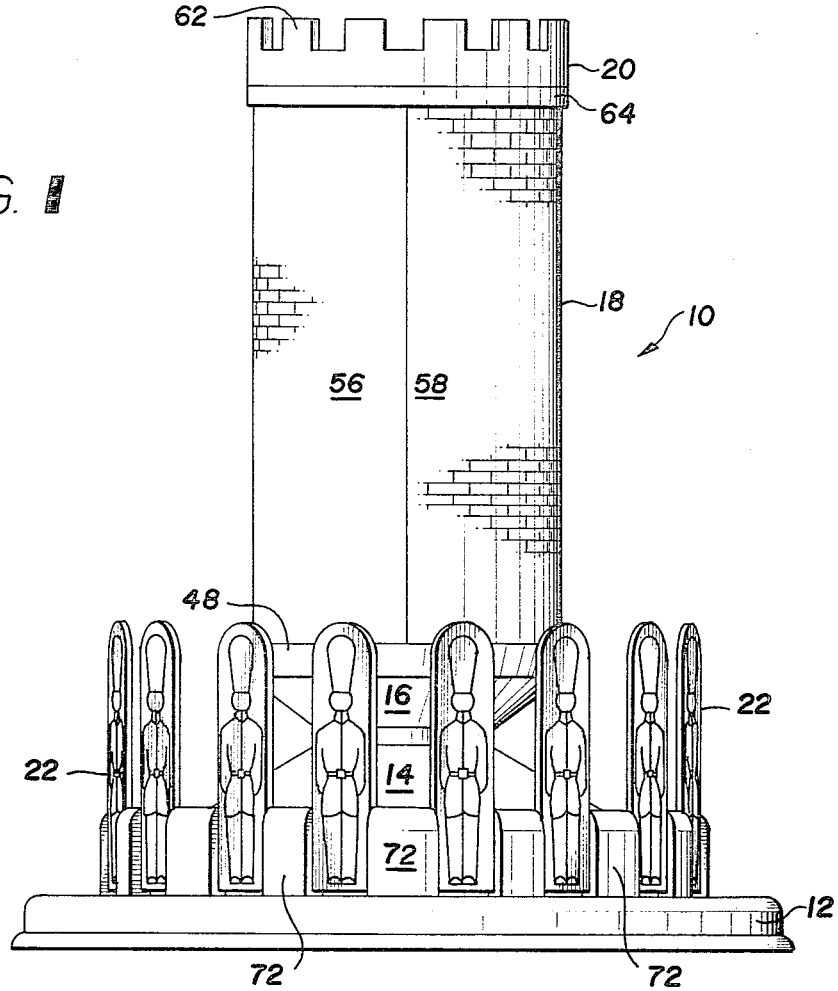
FIG. 1 is an elevational view of the assembled knock-down type marble runway game apparatus comprising the present invention.

Referring to the drawings, numeral 10 designates the knock-down type, marble runway game apparatus as a whole which comprises a supporting base 12, a lower inverted funnel section 14, an upper funnel section 16, a circular tower 18, a tower roof 20, and a plurality of target members 22 of suitable material and preferably, a strong plastic.

The base 12 is circular and provided adjacent its periphery with an annular marble receiving channel 24 having a horizontal target supporting shoulder 26. The base 12 then inclines radially inwardly and upwardly to form a ramp 28 and terminates in a central dome 30 with a peaked top 32.

Figure 3:
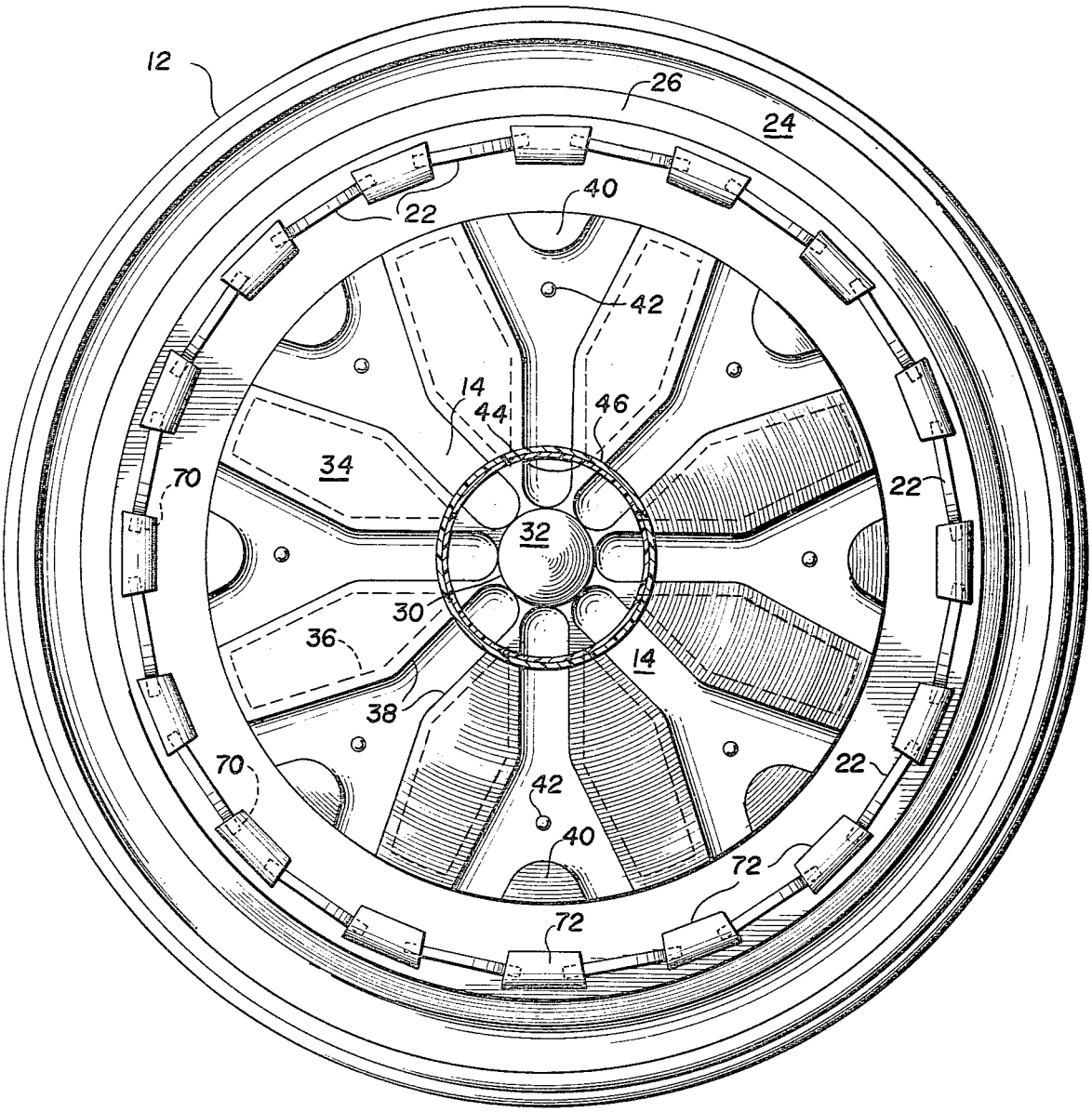
FIG. 3 is a substantially horizontal section view thereof taken on the line 3—3 of FIG. 2.

The lower funnel section 14 rests on and extends parallel to the ramp 28 and its dome 30 by means of upstanding radially extending exit marble-runway-defining partitions 34 molded integrally with the ramp 28. These may be of solid material or spaced partitions as indicated in dotted lines 36 in FIG. 3.

The exit runways 38 so defined are bifurcated at their radially outer ends by means of semi-circular shaped partitions 40 also molded integrally with the ramp so as to direct a marble against each target member 22. Small, upstanding semi-circular projections 42 are spaced just radially inward of the partitions 40 to ensure that marbles do not get stuck in the partitions 34.

The upper periphery of the inverted funnel section 14 is provided with an inner annular rib 44 for the reception of a similar outer rib 46 on the lower peripheral edge of the upper funnel section 16 whose upper peripheral edge includes an outer rib 48 for the reception of an inner peripheral rib 50 on the lower end of the circular tower 18. It is to be noted that rib 44 defines with the dome 30, an annular opening 52 for the passage of marbles from the upper funnel section 16 to the exit runways 38 formed on the ramp 28.

The circular tower 18 is provided with an internal helical marble ramp 54 which is readily molded therewith by forming the tower 18 of two separate halves 56 and 58, each having an inner upper end shouldered rib 60. The tower 18 is covered with a roof 20 having upstanding crenellations 62 so as to resemble a castle, and a depending peripheral rib 64 which rests upon the shoulder 66 of the tower rib 60 and enables rotation of the roof thereon.

A plurality of circumferentially spaced apertures 68 are formed in the surface of the roof so as to enable the dropping of a marble through a selected one thereof to control the length of the run—and hence the speed—of the marble down the runway 54. This enables a player to have some control as to which target the marble will hit.

The target members 22 are flat and may bear a decalcomania of a soldier, etc. Each is provided with integral, laterally projecting pivot pins 70 below their centers of gravity which are received in apertures in adjacent supporting members 72. When the targets and their supports are arranged around the base shoulder 26, the slight friction between the pins 70 and the apertures due to the slightly arcuate arrangement, is adequate to maintain the targets in vertical position until struck by a marble.

Figure 4:
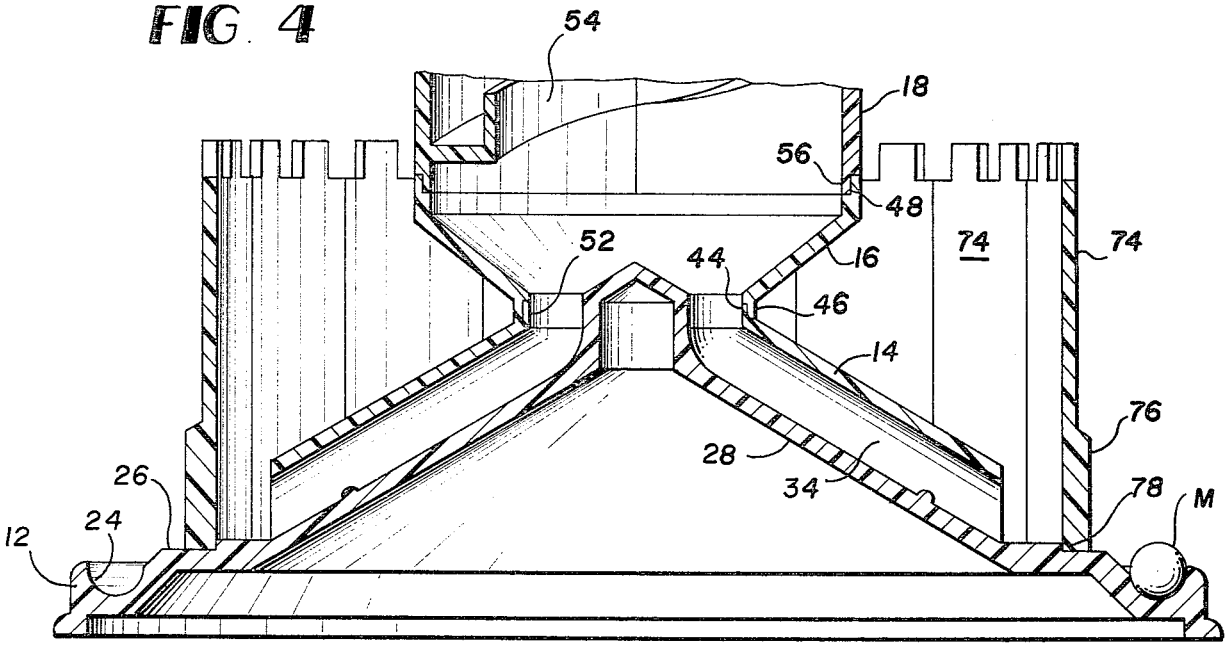
FIG. 4 is a fragmentary central vertical sectional view of another form of the invention.
Figure 2:
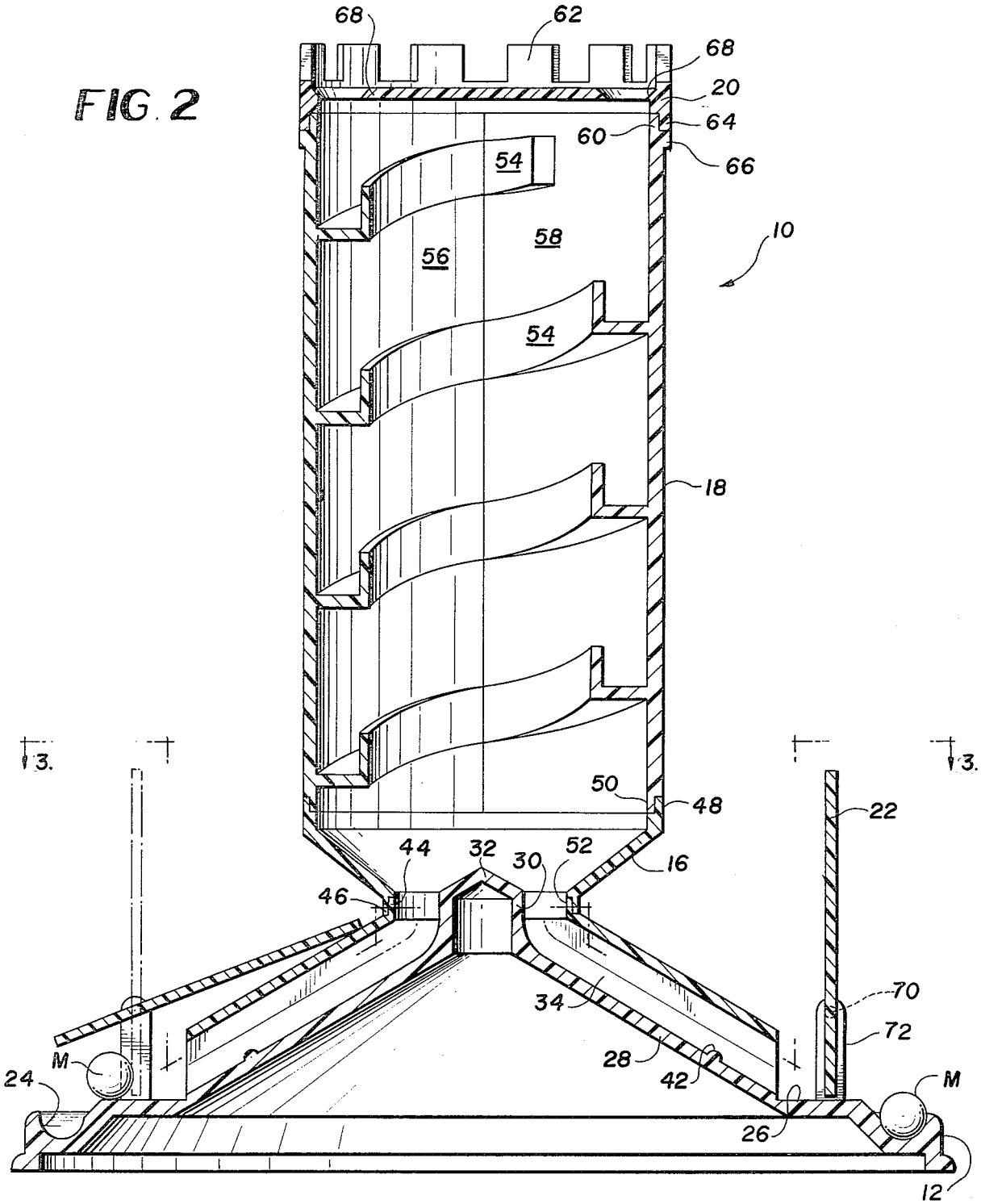
FIG. 2 is a central, vertical cross-sectional view thereof.

The embodiment of the invention shown in FIG. 4 differs from the foregoing only in that the targets are wall members 74 having enlarged bases 76 arranged in side-by-side relationship on the shoulder 26 against a shoulder 78. When struck by a marble M, the targets 74 fall outwardly off of the flange 26.

It will now be readily apparent that the game apparatus comprising the present invention may be readily assembled for play by a child with each part correctly positioned and so maintained during play due to the novel structure described. The base 12 is positioned where desired and the lower funnel section 14 is placed thereon and is centered over the dome 30. The upper funnel section 16 is now positioned so that the peripheral ribs 44 and 46 interfit and the two tower halves 56 and 58 are joined with the runways 54 contiguous and so that the ribs 48 and 50 are interfitting. The roof 20 is now positioned so as to interfit the ribs 60 and 64. It is to be noted that the ribs 48 and 64 prevent separation of the tower halves 56 and 58. The targets 22 are now positioned as described.

In the playing of the game, the players imagine that they are attacking a castle guarded by soldier targets or a wall. In turn, marbles are dropped through one of the roof apertures 68 onto selected spots on the runway 54 and discharge therefrom into and around the upper funnel section 16 where they drop through the opening 52 into one of the exit runways 38 defined by the partitions 34 or 36, and down the ramp 28 to engage and knock over one of the targets 22 or 74. The game is won by the player who knocks down the last target.

It is to be understood that the forms of my invention herewith shown and described are to be taken as preferred examples of the same and that various changes in the shape, size and arrangement of parts may be resorted to without departure from the spirit of the invention or the scope of the subjoined claims.

What is claimed is:

1. A skill game apparatus comprising, in combination, a stationary base having a target supporting, horizontal peripheral shoulder for the reception of movable targets and an inner upwardly inclined surface defining a ramp terminating in a peaked dome; upstanding partitions defining exit marble runways leading to said peripheral shoulder extending parallel with said ramp and formed integrally therewith; an inverted funnel section resting on said partitions and terminating in a rib adjacent said dome and spaced therefrom to permit passage of a marble therebetween; an upper funnel section for directing marbles to said marble exit runways having a lower cooperating rib supported on said first-mentioned rib and terminating in an outer upper rib; an upwardly extending tower supported on said outer upper rib and terminating in an inner rib having an outer shoulder; a helical marble runway fixed to the inner surface of said tower for the discharge of a marble into said upper funnel section; and a rotatable roof having an outer depending rib mounted on said outer shoulder of said inner rib; said rotatable roof having a plurality of apertures for the dropping of a marble therethrough at a selected position onto said helical runway.

2. The combination recited in claim 1; and a plurality of targets mounted on the shoulder of said base.

3. The combination recited in claim 1 wherein said roof, tower, and upper and lower funnel sections are detachably positioned on said base.

4. The combination recited in claim 1 wherein said tower and helical runway is formed of two sections.

5. The combination recited in claim 4 wherein the tower sections are held in assembled position by said outer ribs of said upper funnel section and said roof.

6. The combination recited in claim 1; and a marble retaining channel formed in the outer periphery of said base.

7. A skill game apparatus comprising, in combination, a stationary base having a target supporting, horizontal peripheral shoulder for the reception of movable targets and an inner upwardly inclined surface defining a ramp terminating in a peaked dome; upstanding partitons defining exit marble runways leading to said peripheral shoulder extending parallel with said ramp and formed integrally therewith; an inverted funnel section resting on said partitions concentrically with said dome but spaced therefrom to permit passage of a marble therebetween; an upper funnel section for directing marbles to said marble exit runways mounted on said inverted funnel section; an upwardly extending tower mounted on and concentrically with said upper funnel section and including a helical marble runway on the inner surface thereof for the discharge of marbles into said funnel; and a rotatable roof having a plurality of apertures mounted on said tower to enable the dropping of marbles therethrough at a selected position onto said helical runway.

* * * * *